United States Patent [19]

Rothe et al.

[11] 4,166,310

[45] Sep. 4, 1979

[54] METHOD OF ALTERING AN AXIAL IMPELLER/STATOR VANE COMBINATION

[75] Inventors: Kurt Rothe, Pacific Palisades; Raymond B. Furst, Northridge; Charles E. Nielson, Canoga Park, all of Calif.

[73] Assignee: Rockwell International Corporation, El Segundo, Calif.

[21] Appl. No.: 902,149

[22] Filed: May 2, 1978

Related U.S. Application Data

[63] Continuation-in-part of Ser. No. 803,713, Jun. 6, 1977, abandoned.

[51] Int. Cl.[2] ..... B21H 7/16

[52] U.S. Cl. ..... 29/23.5; 29/156.4 R; 29/156.8 R; 29/404

[58] Field of Search ..... 29/156.8 B, 156.8 R, 29/157 C, 401 B, 156.4 R, 23.5; 415/199.2, 150, 149, 148, 167, 199.4, DIG. 3; 416/62

[56] References Cited

U.S. PATENT DOCUMENTS

| | | | |
|---|---|---|---|
| 2,831,434 | 4/1958 | Paashaus | 415/DIG. 3 |
| 2,946,288 | 7/1960 | Carter, Jr. et al. | 415/150 X |
| 3,286,641 | 11/1966 | Delao et al. | 415/150 X |
| 3,543,368 | 12/1970 | Marlow | 415/DIG. 3 |
| 3,664,001 | 5/1972 | Pilarczyk | 29/156.4 R |
| 3,704,500 | 12/1972 | Okamoto | 29/156.8 B X |

FOREIGN PATENT DOCUMENTS

| | | | |
|---|---|---|---|
| 578473 | 6/1959 | Canada | 415/DIG. 3 |
| 333443 | 8/1930 | United Kingdom | 415/DIG. 3 |
| 613892 | 12/1948 | United Kingdom | 415/DIG. 3 |
| 700859 | 12/1953 | United Kingdom | 415/DIG. 3 |

*Primary Examiner*—Horace M. Culver

*Attorney, Agent, or Firm*—L. Lee Humphries; Robert M. Sperry

[57] ABSTRACT

Axial impellers for waterjet pumps, for example, require for each horsepower level a different stator vane housing in order to avoid stator vane cavitation damage. The invention allows the use of one stator housing for a wide horsepower range at constant speed by holding the ratio of impeller discharge flow coefficient over head coefficient constant.

6 Claims, 8 Drawing Figures

NOMINAL POWER LEVELS AT 2100 RPM FOR INDICATED TRIMS

POWER ABSORPTION VS. TRIM AND SPEED

IMPELLER AND NOZZLE TRIM RELATION

INDUCER FRONT BLADE ROW TRIM

METHOD OF ALTERING AN AXIAL IMPELLER/STATOR VANE COMBINATION

CROSS-REFERENCE TO RELATED APPLICATIONS

This application is a Continuation-in-Part of Ser. No. 803,713 filed June 6, 1977, and abandoned May 5, 1978.

BACKGROUND OF THE INVENTION

1. Field of the Invention

This invention relates to axial flow pumps.

More particularly, this invention relates to axial flow waterjet pumps wherein different horsepower inputs are adapted to a single stator housing by trimming as required the axial impeller section and the pump nozzle section. This permits a single basic design to be used for a wide range of applications with resulting economy.

2. Description of the Prior Art

There are many patents that attempt to deal with fluid flow rate control of a basic design. For example, U.S. Pat. No. 3,664,001 provides for adjustment of the compressor flow rate. The free edges of the unshrouded impeller are machined off, thus reducing the blade height and moving the operating point to the lower desired flow rate. To cover the impeller correctly, new stationary shrouds have to be supplied. In addition, the free edges of the diffuser blades have to be machined off in such a fashion as to match the impeller exit. This is made possible by the installation of separate annular diffusers. The invention thus allows for changing the design flow rate of a compressor (or pump) and does not deal with a change in horsepower input utilizing an unchanged stator housing as does the present invention.

Swiss Pat. No. 368,160 discloses a design concept that adjusts the operating point of an axial flow pump by reducing the tip diameter of the axial pump rotor and filling the gap between the housing and rotor with an insert. The instant invention again deals with horsepower changes that do not alter the pump housing or the stators; only the impeller configuration.

Any waterjet propulsion system driven by a fixed speed drive such as a diesel engine can be adjusted to any power level by either changing speed by a gear change or changing the impeller and stator vane housing. It is desirable, particularly in commercial applications, to eliminate the costly gearbox. Without the gearbox, the system can be matched by changing the pump size in accordance with the engine power level. This approach is expensive because the major pump parts must be changed. This is true because pump horsepower is a function of flow and headrise where, if the same headrise is assumed, the flow drops from the 100% level at 1000 HP to the 80% level at 800 HP. As a consequence, the impeller inlet as well as exit velocity triangles change requiring new hardware. If, in this example, no stator hardware change is adapted, a low efficiency would result, coupled with a fast stator vane deterioration due to cavitation damage.

Other combinations of impeller headrise and flow rate can be selected to satisfy the horsepower conditions, some of which are in the prior art. All of them, however, require new pump hardware for each horsepower level. The one exception, the subject of this invention, allows the same pump hardware to be used for a wide horsepower range, requiring only a trimming modification of the axial impeller and nozzle opening. The instant invention reduces the necessary hardware changes to a minimum, eliminates the gearbox for fixed speed engine applications, and allows the same pump hardware to be used for a wide horsepower range at a constant speed while maximizing the stator vane life.

Axial impeller waterjet pumps require a stator vane section downstream of the impeller in order to remove the whirl for optimum jet flow conditions. This stator is subject to erosion due to cavitation unless the stator vane inlet angle matches the flow angle exiting the trailing edge of the impeller blade. As horsepower is changed, the axial impeller, as well as the stator vane section must be redesigned in order to result in cavitation-free stator flow (unless the pump speed is changed as by use of a gearbox). The invention eliminates the redesign by trimming the trailing edge of the blades of the axial impeller such that the velocity direction entering the stator vane section is unchanged. Thus, the pump rotor diameter and housing containing the fixed stator vanes remain unchanged; thereby allowing the use of a single pump housing for different horsepower ranges in a family of waterjets. The pump nozzle is trimmed to match the required flow rate for each power level. One nozzle casting is used.

The instant invention will accommodate horepower levels, for example, between 500 to 1000 HP at a constant pump speed without experiencing stator vane cavitation damage by applying the following ground rules:

(a) The stator inlet tip diameter must be constant for all horsepowers.

(b) The stator inlet hub diameter must be constant for all horsepowers.

(c) The stator vane shape is constant for all horsepowers.

(d) The ratio of impeller discharge flow coefficient over head coefficient must be kept in a range which results in stator vane cavitation margin (nearly constant) for all horsepower levels.

None of the foregoing prior art patents accomplish these goals, while the present invention accomplishes all these parameters.

SUMMARY OF THE INVENTION

A method of preventing cavitation damage and loss of pump efficiency to an axial waterjet pump operating substantially at a constant RPM with a fixed stator vane housing section when the engine horsepower range is changed comprising the step of varying the length of an impeller blade by a predetermined amount to obtain the correct velocity direction of flow entering the fixed stator vane section for maintaining the proper stator vane inlet angle with a change in engine horsepower range, the change of length of the impeller blade being functionally related to the impeller blade exit angle required to manage horsepower range.

In order to use the same stator vane geometry for all horsepower levels, it is necessary that the velocity triangles at the exit of the axial impeller are similar such that the absolute flow direction entering the stator remains essentially unchanged. Where the axial impeller tip speed is constant (RPM and axial impeller diameter constant, the ratio of the axial flow velocity over the tangential flow velocity determines the flow angle. With the axial impeller tip speed constant, then the ratio of flow coefficient over head coefficient is constant. The foregoing, therefore, is the condition for identical stator vane housings for different horsepower levels.

For example, in a family of diesel engines from 500 to 1000 HP operating at about 2000 RPM, a common stator vane housing may be utilized by satisfying an equation whereby the 500 HP engine will fall on a common line on a graph of flow coefficient versus head coefficient with an engine producing 1000 HP. The only remaining task then is to adjust the axial impeller head coefficient and the pump flow rate by respectively trimming the axial impeller and the pump nozzle depending on the horsepower level of the engine utilized.

It is, therefore, an object of this invention to allow the use of a stator vane housing having identical geometry for a wide range of horsepower, thus arriving at a family of waterjet propulsion pumps with minimum hardware variations.

An advantage over the prior art is the use of a common stator vane housing for different horsepower levels, thereby eliminating the need to change to larger or smaller diameter impellers or different gearbox ratios to accommodate different power inputs to a waterjet pump.

The above-noted objects and advantages of the present invention will be more fully understood upon a study of the following detailed description in conjunction with the detailed drawings.

DESCRIPTION OF THE PREFERRED EMBODIMENTS

Figure 1:
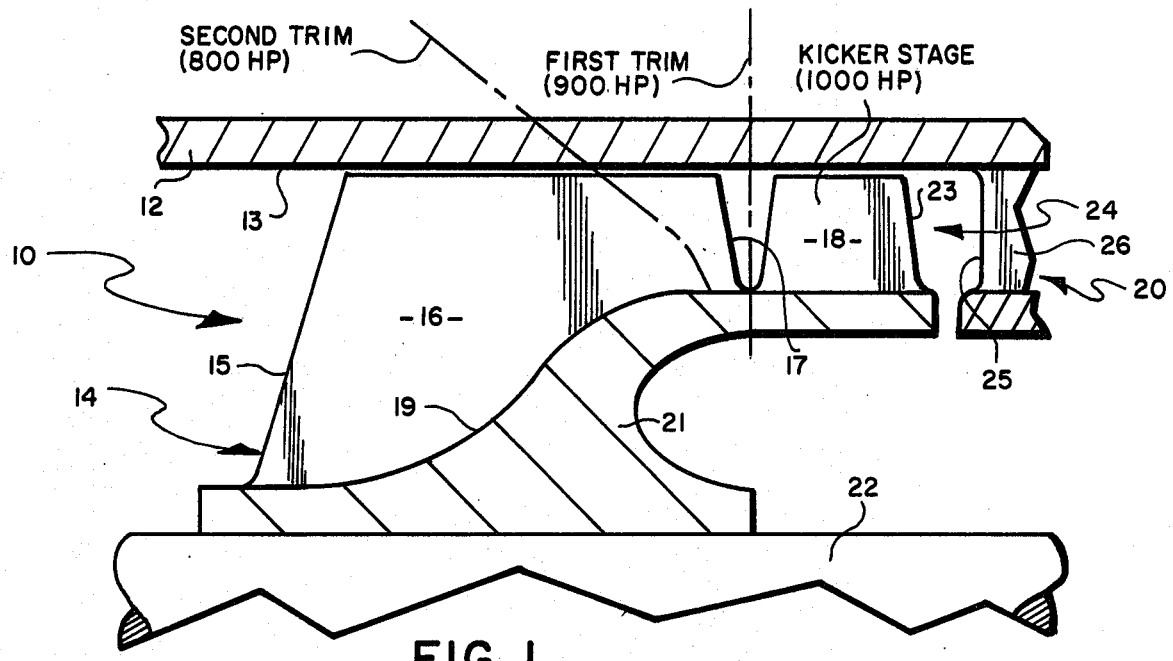
FIG. 1 is a partially cutaway cross-section of an impeller section of an axial flow pump.

Referring to FIG. 1, the axial waterjet pump generally designated as 10 consists of housing 12, impeller section generally designated as 14, and stator section generally designated as 20. The impeller 14 is driven on shaft 22 connected to a power source (not shown). The impeller consists of a main blade section 16 having a leading edge 15 and a trailing edge 17. Downstream of trailing edge 17 may be an additional blade row 18 referred to, for example, as a kicker stage. An annulus 24 is formed between the outer surface 19 of body 21 of the impeller 14 and the inner wall 13 of housing 12. Flow exiting the trailing edge 23 of kicker stage 18 enters the stator section 20 at leading edge 25 of stator vane 26. In order to maintain the velocity direction of flow entering the stator section 20 at leading edge 25 of stator vane 26 at different engine horsepower levels, the blade area and exit angle of impeller 14 is changed.

In order to use the same stator vane geometry for all horsepower levels, it is necessary that the velocity triangles at the exit of the axial impeller are changed in such a fashion that the absolute flow direction entering the stator remains unchanged as heretofore described. Since the axial impeller tip speed $u_T$ is constant (RPM and axial impeller diameter constant) the ratio of $$\left(\frac{C_m}{C_u}\right) = \frac{\text{meridional velocity}}{\text{tangential velocity}}$$

determines the flow angle. With u constant the ratio $C_m/C_u$=constant is equal to the ratio of $$\left(\frac{Cm/u}{g\,H/u^2}\right) = \frac{\phi}{\psi} = \frac{\text{flow coefficient}}{\text{head coefficient}} = \text{constant.}$$

Which is the condition for identical stator vane housings for different horsepower levels.

Figure 2:
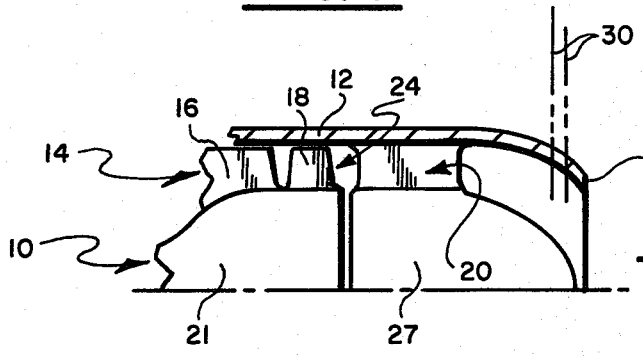
FIG. 2 is a partially cutaway cross-section of the nozzle section of an axial flow pump.
Figure 3:
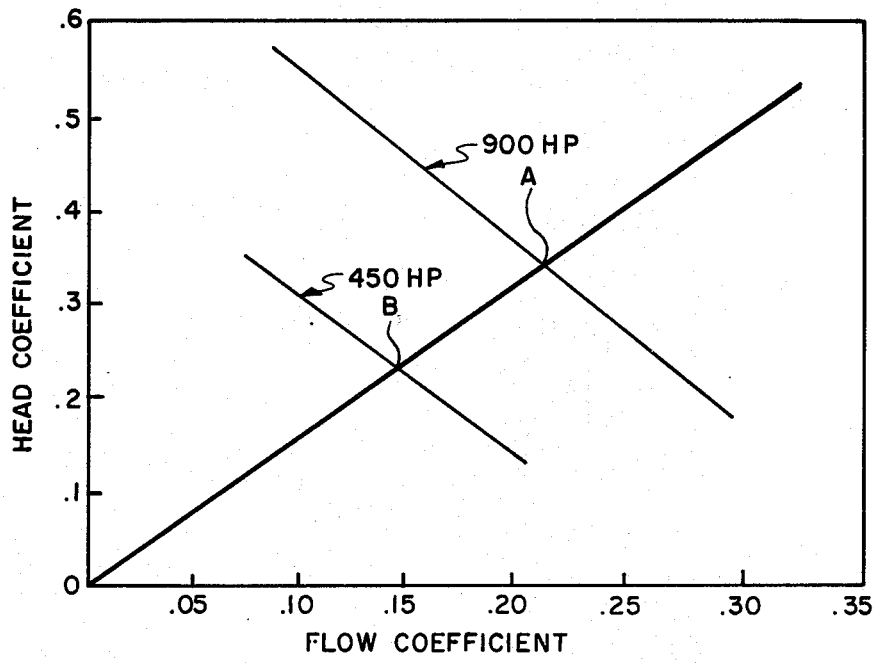
FIG. 3 is a chart illustrating flow coefficient versus head coefficient for different power inputs to an axial flow pump.

FIG. 3 illustrates graphically the line of common stator vanes, for example, a diesel engine family from 450 to 1025 HP. It can be seen any such line can be drawn starting from the point zero and the condition $\phi/\psi$=constant is satisfied; however, as soon as an operating point, for example, for a diesel developing 900 HP at 2000 RPM, is selected the operating points of all other pumps are fixed since they must satisfy the $\phi/\psi$=constant requirement. As an example, let us assume that for 900 HP and 2000 RPM the operating point A (FIG. 2) was selected. Point A is defined by $\phi_A=0.204$ and $\psi_A=0.338$. For 450 HP and 2000 RPM, we then must select Point B with a flow coefficient $\phi_B=0.144$ and a head coefficient of $\psi_B=0.235$ since $$\phi_A \times \psi_A \times 450/900 = \phi_B \times \psi_B$$

For the above example, it is assumed that the ratio of impeller inlet to discharge flow coefficient is a constant. Satisfying the above equation produces a unique design for the desired power and permits the use of the same stator vane housing 12 for different HP levels. The only remaining task is to adjust the axial impeller head coefficient and the pump flow rate, which can now be done by respectively trimming the axial impeller and the pump nozzle (FIG. 2).

Figure 4:
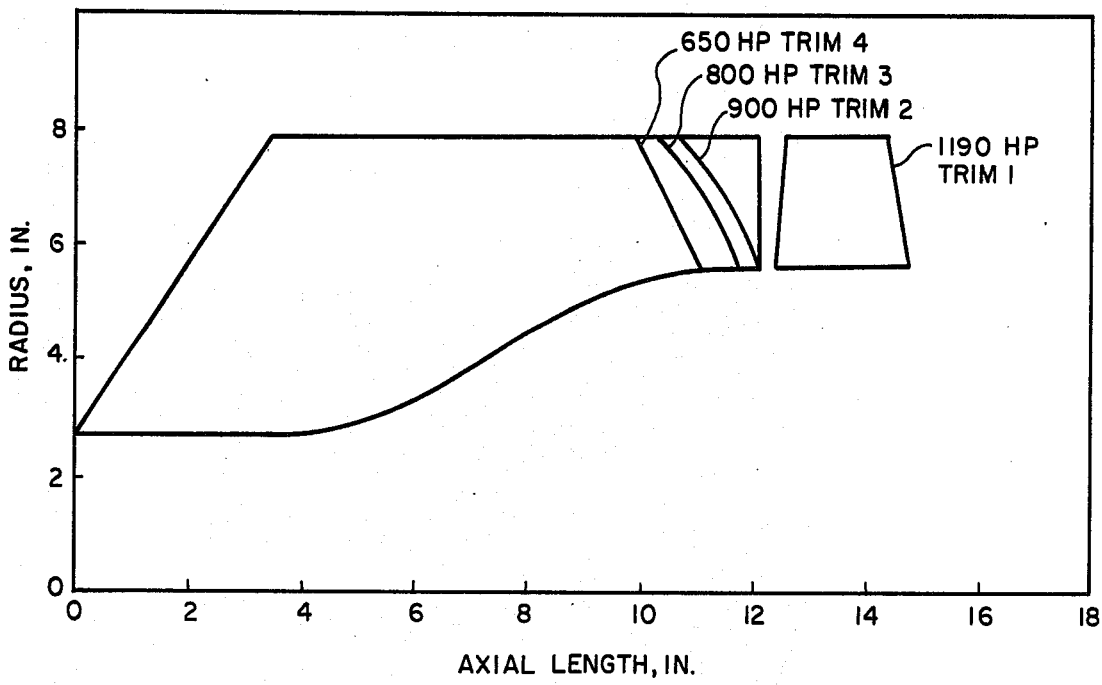
FIG. 4 is a chart indicating an example of a specific impeller illustrating nominal power levels for indicated inducer trims, FIGS. 5*a* and 5*b* graphs illustrate impeller and nozzle trim relation.
Figure 5A:
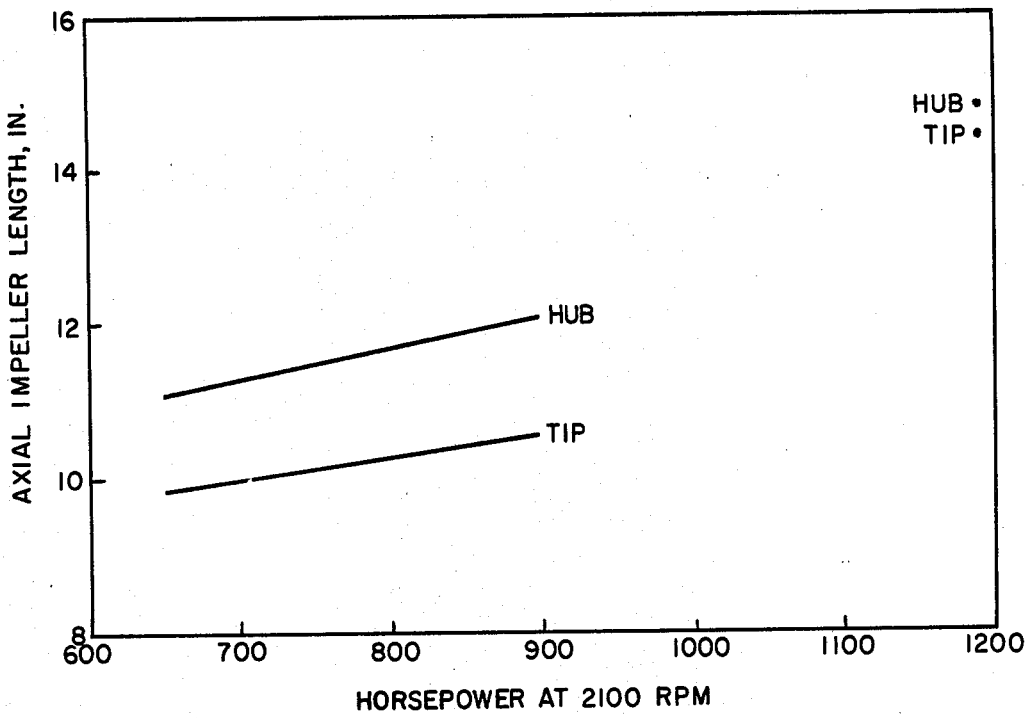

With reference to FIGS. 4 and 5*a*, an impeller, for example, having a specific diameter and length may be trimmed as indicated.

FIGS. 1 and 4 show as an example how the same basic axial impeller has to be trimmed in order to satisfy a horsepower range from about 600 to 1200 HP.

Turning now to FIG. 2, the nozzle section 29 of waterjet pump 10 may be trimmed back (30) to accommodate greater through flow for higher horsepower engines or slightly trimmed for intermediate power levels without changing the stator housing section 20. Thus, a common waterjet pump-stator housing provides a family of waterjets with widely divergent powerplant options.

Figure 5B:
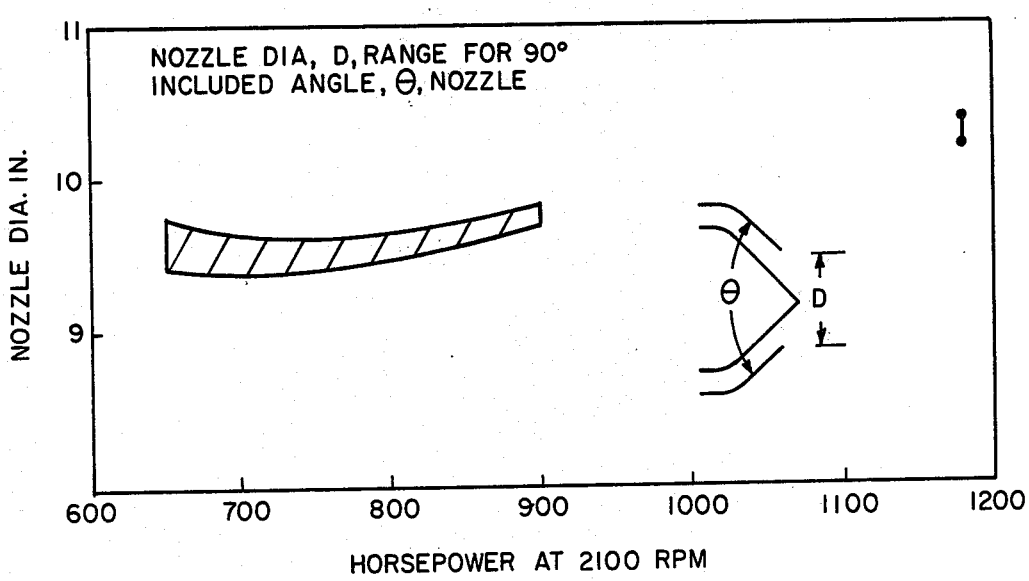

FIG. 5*b* shows the nozzle diameter versus horsepower trim curve for a specific pump.

FIG. 3 illustrates a common line where the ratio of the flow coefficient and head coefficient are constant. A 900 horsepower engine falls on the line at Point A while the 450 horsepower engine is a Point B, the blade area of the impeller section being trimmed for the lower horsepower range, the nozzle section 29 being trimmed to accommodate higher flow rates for the larger horsepower engines.

Figure 6:
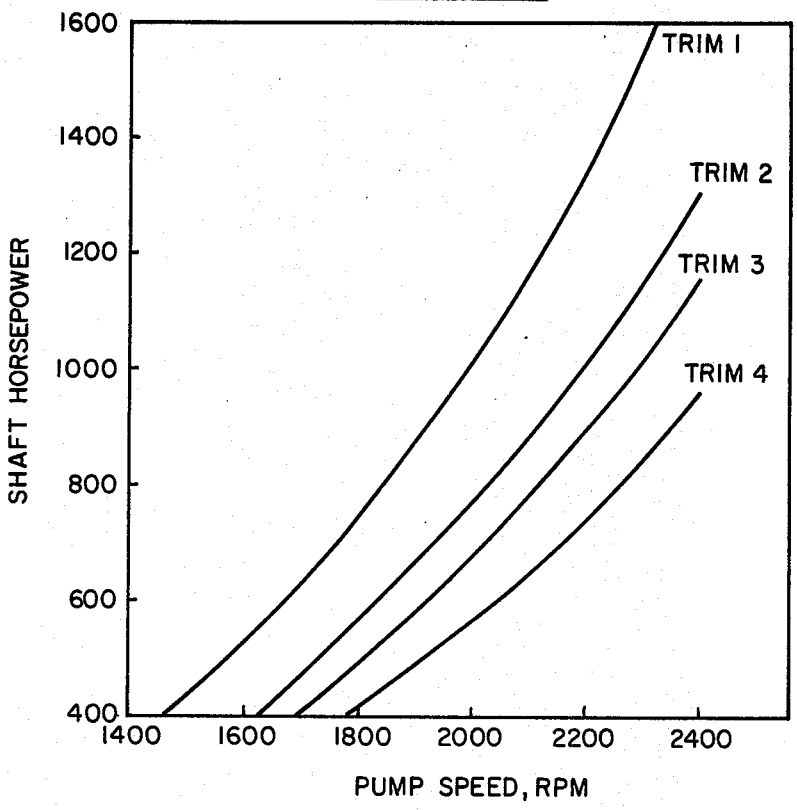
FIG. 6 is a graph showing power absorption versus trim and speed.

FIG. 6 shows the pump power absorption as a function of impeller trim and rotating speed.

Figure 7:
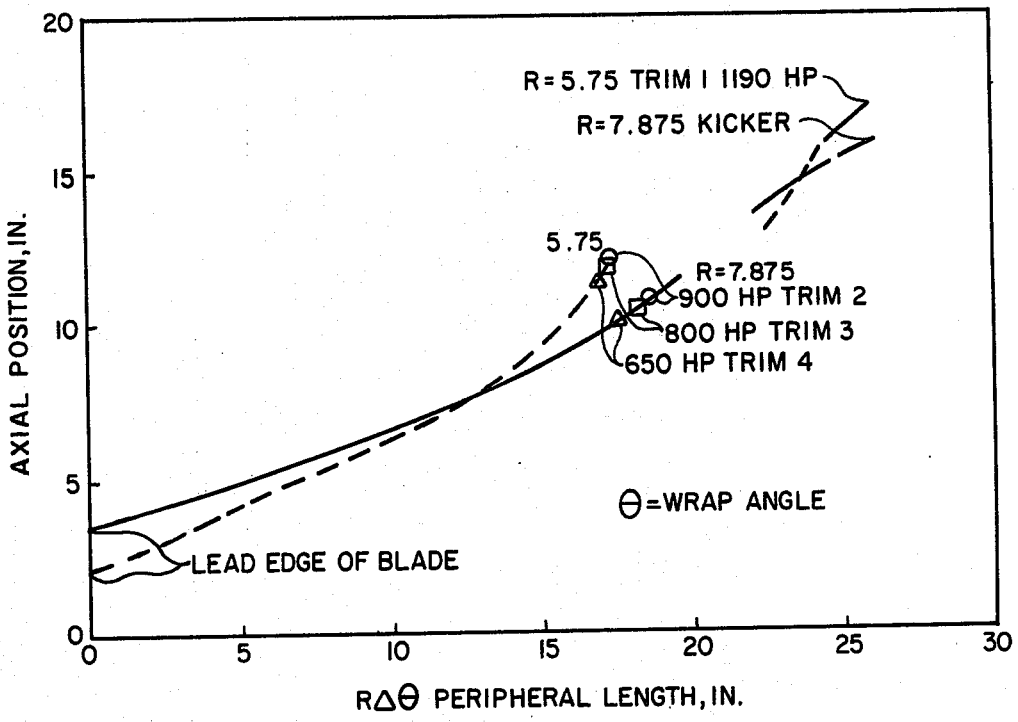
FIG. 7 is a graph illustrating a pair of curves that represent the centerline of a pair of blades and is a projection of an unwrapped cylinder wherein a specific inducer undergoes a front row blade trim.

The curves illustrated in FIG. 7 represent, for example, the centerlines and blade angles of a specific pair of front row blades on an unwrapped cylinder. The chart indicates the amount of blade to be removed from the inducer hub and tip for each power level for a particular size pump. The separation between trim 1 and trims 2 through 4 indicate the complete removal of the kicker stage 18 from impeller 14 (FIG. 1) when the power level is reduced from 1190 horsepower to 900 horsepower.

This invention teaches a method that will accommodate all power levels and pump combinations. For example, if all of the numbers were to double wherein the power ranges from 1800 to 2380 horsepower and the pump size is enlarged accordingly using the same inducer configuration as shown in FIGS. 4 through 7, the pump housing flexibility as heretofore described will remain the same.

It will, of course, be realized that various modifications can be made in the design and operation of the present invention without departing from the spirit thereof. Thus, while the principal, preferred construction, and mode of operation of the invention have been explained and what is now considered to represent its best embodiment has been illustrated and described, it should be understood that within the scope of the appended claims the invention may be practiced otherwise than as specifically illustrated and described.

We claim:

1. A method of preventing cavitation damage and loss of pump efficiency to an axial waterjet pump operating substantially at a constant RPM with a fixed stator vane housing section when the engine horsepower range is changed comprising the steps of:

varying the length and therefore area of an impeller blade by a predetermined amount to obtain the correct velocity, and varying the blade angle without changing the direction of flow entering the fixed stator section to maintain the proper stator vane inlet angle for a predetermined change in engine horsepower range, while maintaining the value of $\phi/\psi$ as a constant, where $\phi$ is flow coefficient and $\psi$ is the head coefficient.

2. The invention as set forth in claim 1 wherein said impeller further includes a kicker stage downstream of the main impeller blade, said kicker stage comprises additional blade area to accommodate an engine at the top of said horsepower range.

3. The invention as set forth in claim 2 wherein said kicker stage is removed from said impeller to accommodate an engine in the middle of said horsepower range.

4. The invention as set forth in claim 3 wherein the remaining main impeller blade is modified by removing blade area from the trailing edge of said impeller blade to accommodate an engine in the lower horsepower range.

5. The invention as set forth in claim 4 further comprising altering a nozzle portion of said axial waterjet pump to accommodate said change of engine horsepower.

6. The invention as set forth in claim 5 wherein said nozzle opening is enlarged to accommodate engines at the top of said horsepower range.

* * * * *